US011098684B2

(12) United States Patent
Takemura et al.

(10) Patent No.: US 11,098,684 B2
(45) Date of Patent: Aug. 24, 2021

(54) FUEL SUPPLY DEVICE

(71) Applicant: AISAN KOGYO KABUSHIKI KAISHA, Obu (JP)

(72) Inventors: Morihiro Takemura, Nisshin (JP); Koji Yoshida, Commerce Township, MI (US); Kensuke Niwa, Nagoya (JP); Satoshi Nakamura, Ichinomiya (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 17/042,227

(22) PCT Filed: Feb. 14, 2019

(86) PCT No.: PCT/JP2019/005243
§ 371 (c)(1),
(2) Date: Sep. 28, 2020

(87) PCT Pub. No.: WO2019/187738
PCT Pub. Date: Oct. 3, 2019

(65) Prior Publication Data

US 2021/0025362 A1 Jan. 28, 2021

(30) Foreign Application Priority Data

Mar. 28, 2018 (JP) ..... JP2018-061621

(51) Int. Cl.
*F02M 37/10* (2006.01)

(52) U.S. Cl.
CPC ..... *F02M 37/10* (2013.01)

(58) Field of Classification Search
CPC ..... F02M 37/10; F02M 37/103; F02M 37/106
See application file for complete search history.

(56) References Cited

U.S. PATENT DOCUMENTS 2,442,639 A * 6/1948 Curtis ..... F02M 37/106 137/13
4,844,704 A * 7/1989 Jiro ..... B01D 35/0273 417/307

(Continued)

FOREIGN PATENT DOCUMENTS

JP 2007032563 A 2/2007
JP 2008215306 A 9/2008

(Continued)

OTHER PUBLICATIONS

PCT/JP2019/005243 International Preliminary Report on Patentability dated Oct. 8, 2020 (3 p.).

(Continued)

*Primary Examiner* — Joseph J Dallo
*Assistant Examiner* — Kurt Philip Liethen
(74) *Attorney, Agent, or Firm* — Conley Rose, P.C.

(57) ABSTRACT

A fuel supply device includes a fuel pump, a pump case, a cap, an O-ring, and a connection assembly. The pump case includes a case main body configured to receive the fuel pump and a discharge port connector. The cap includes a suction port connector. The O-ring is interposed between a fuel discharge port of the fuel pump and discharge port connector. The connection assembly includes a plurality of engagement projections and a plurality of engagement pieces configured to mate and engage with the engagement projections. The fuel discharge port of the fuel pump is configured to reach the O-ring coupled to the discharge port connector of the pump case simultaneous with the engagement between the engagement projections and the engagement pieces when the fuel suction port of the fuel pump and the suction port connector of the cap are connected together.

4 Claims, 8 Drawing Sheets

(56) References Cited

U.S. PATENT DOCUMENTS

| | | | | |
|---|---|---|---|---|
| 5,263,458 | A * | 11/1993 | Fujino | F02B 37/105 123/514 |
| 5,396,872 | A * | 3/1995 | Ruger | B60K 15/077 123/514 |
| 5,429,096 | A * | 7/1995 | Fukasawa | F02D 33/006 123/514 |
| 5,642,718 | A * | 7/1997 | Nakai | F02M 37/106 123/497 |
| 6,123,511 | A * | 9/2000 | Sertier | B60K 15/077 123/509 |
| 7,182,869 | B2 * | 2/2007 | Catlin | B01D 35/0273 210/416.4 |
| 7,303,378 | B2 * | 12/2007 | Kleppner | B60K 15/077 417/87 |
| 7,318,422 | B2 | 1/2008 | Douyama et al. | |
| 8,590,563 | B2 * | 11/2013 | Martin | F02M 37/025 137/565.22 |
| 2008/0216801 | A1 | 9/2008 | Kanamaru et al. | |
| 2017/0254303 | A1 * | 9/2017 | Takahashi | F02M 37/0076 |
| 2017/0343125 | A1 | 11/2017 | Takahashi et al. | |
| 2018/0112659 | A1 * | 4/2018 | Sakai | F02M 37/041 |
| 2019/0331073 | A1 | 10/2019 | Higashi et al. | |

FOREIGN PATENT DOCUMENTS

| | | | |
|---|---|---|---|
| JP | 2009221898 | A | 10/2009 |
| JP | 2009236006 | A | 10/2009 |
| JP | 2011157900 | A | 8/2011 |
| JP | 2017210899 | A | 11/2017 |
| JP | WO017141628 | A1 | 10/2018 |

OTHER PUBLICATIONS

English Translation of PCT/JP2019/005243 International Preliminary Report on Patentability dated Oct. 8, 2020 (6 p.).

PCT/JP2049/005243 International Search Report and Written Opinion dated Mar. 19, 2019 (8 p.).

* cited by examiner

FUEL SUPPLY DEVICE

CROSS-REFERENCE TO RELATED APPLICATIONS

The present application is a 35 U.S.C. § 371 national stage application of, and claims to the benefit of, PCT Application No. PCT/JP2019/005243 filed Feb. 14, 2019, which claims priority to Japanese Patent Application No. 2018-061621 filed Mar. 28, 2018, each of which is incorporated herein by reference in its entirety for all purposes.

STATEMENT REGARDING FEDERALLY SPONSORED RESEARCH OR DEVELOPMENT

Not applicable.

BACKGROUND

The present disclosure relates generally to fuel supply devices.

A fuel supply device for supplying fuel within a fuel tank mounted to a vehicle (e.g., an automobile or the like) to an internal combustion engine (i.e., an engine) is described, for example, in Japanese Laid-Open Patent Publication No. 2017-210899. As described in Japanese Laid-Open Patent Publication No. 2017-210899, the fuel supply device a fuel pump, a pump case housing the fuel pump therein, an O-ring disposed between a fuel discharge port of the fuel pump and a discharge port connector of the pump case, and a cap connected to the pump case by a snap-fit. The cap includes a suction port connector to which a fuel suction port of the pump is connected. The snap-fit comprises an engaging portion and an engaged portion, which can be engaged with each other.

SUMMARY

In one aspect of this disclosure, a fuel supply device includes a fuel pump, a pump case, a cap, and a snap-fit. The pump case includes a case main body configured to allow the fuel pump to be axially inserted therein and a discharge port connector configured to be connected to a fuel discharge port of the fuel pump. The cap includes a suction port connector configured to be connected to a fuel suction port of the fuel pump. In addition, the fuel supply device includes a sealing member interposed between the fuel discharge port and the discharge port connector of the pump case. The snap-fit includes a plurality of engaging portions and a plurality of engaged portions configured to engage with each other and connect the pump case to the cap. The fuel discharge port of the fuel pump is configured to reach the sealing member attached to the discharge port connector upon engagement between the engaging portions and the engaged portions of the snap-fit when the fuel suction port of the fuel pump and the suction port connector of the cap are connected to each other.

According to the aspect, embodiments described herein offer the potential to prevent the failure of the sealing member interposed between the fuel discharge port of the fuel pump and the discharge port connector of the pump case during assembly of the fuel supply device.

DETAILED DESCRIPTION

As previously described, the fuel supply device disclosed in Japanese Laid-Open Patent Publication No. 2017-210899 includes a fuel pump, a pump case housing the fuel pump therein, an O-ring disposed between a fuel discharge port of the fuel pump and a discharge port of the pump case, and a cap connected to the pump case by a snap-fit. The cap includes a suction port connector to which a fuel suction port of the fuel pump is connected. The snap-fit comprises an engaging portion and an engaged portion, which can be engaged with each other. To accommodate and hold the fuel pump between the pump case and the cap, the fuel pump with the fuel suction port connected to the suction port of the cap is inserted in the pump case. In the course of inserting the fuel pump, the engaging portion and the engaged portion of the snap-fit begin to engage. However, the fuel discharge port of the fuel pump does not reach an O-ring attached to the discharge port of the pump case upon the initial the engagement of the engaging portion and the engaged portion of the snap-fit. In other words, during the process of the snap-fit engagement, the O-ring begins to engage the fuel discharge port of the fuel pump. Typically, it is necessary to position the O-ring in an appropriate position at the initial stage of engagement of the O-ring. However, according to the above-described structure disclosed in Japanese Laid-Open Patent Publication No. 2017-210899, the process from the positioning of the O-ring at the initial stage to completion of its engagement coincides with the beginning to the completion of the snap-fit engagement. This may result in assembly failure, such as undesirable twisting or biting of the O-ring as engagement between the O-ring to the fuel discharge port proceeds even if the fuel outlet port is misaligned or inclined with respect to the O-ring when the fuel discharge port of the fuel pump reaches the O-ring. Therefore, there has been a need for improved fuel supply devices.

Figure 1:
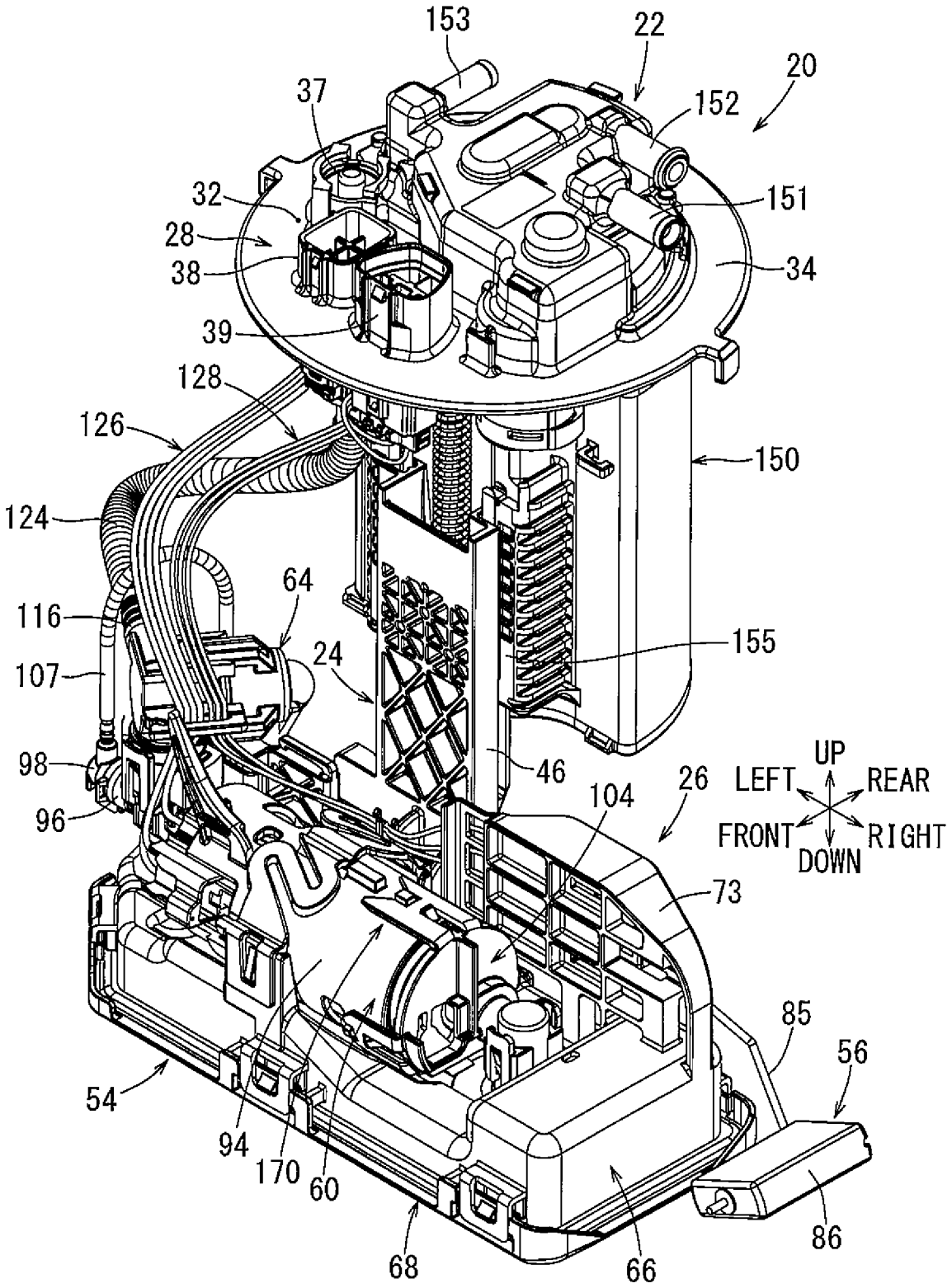
FIG. 1 is a perspective view of a fuel supply device according to an embodiment.
Figure 2:
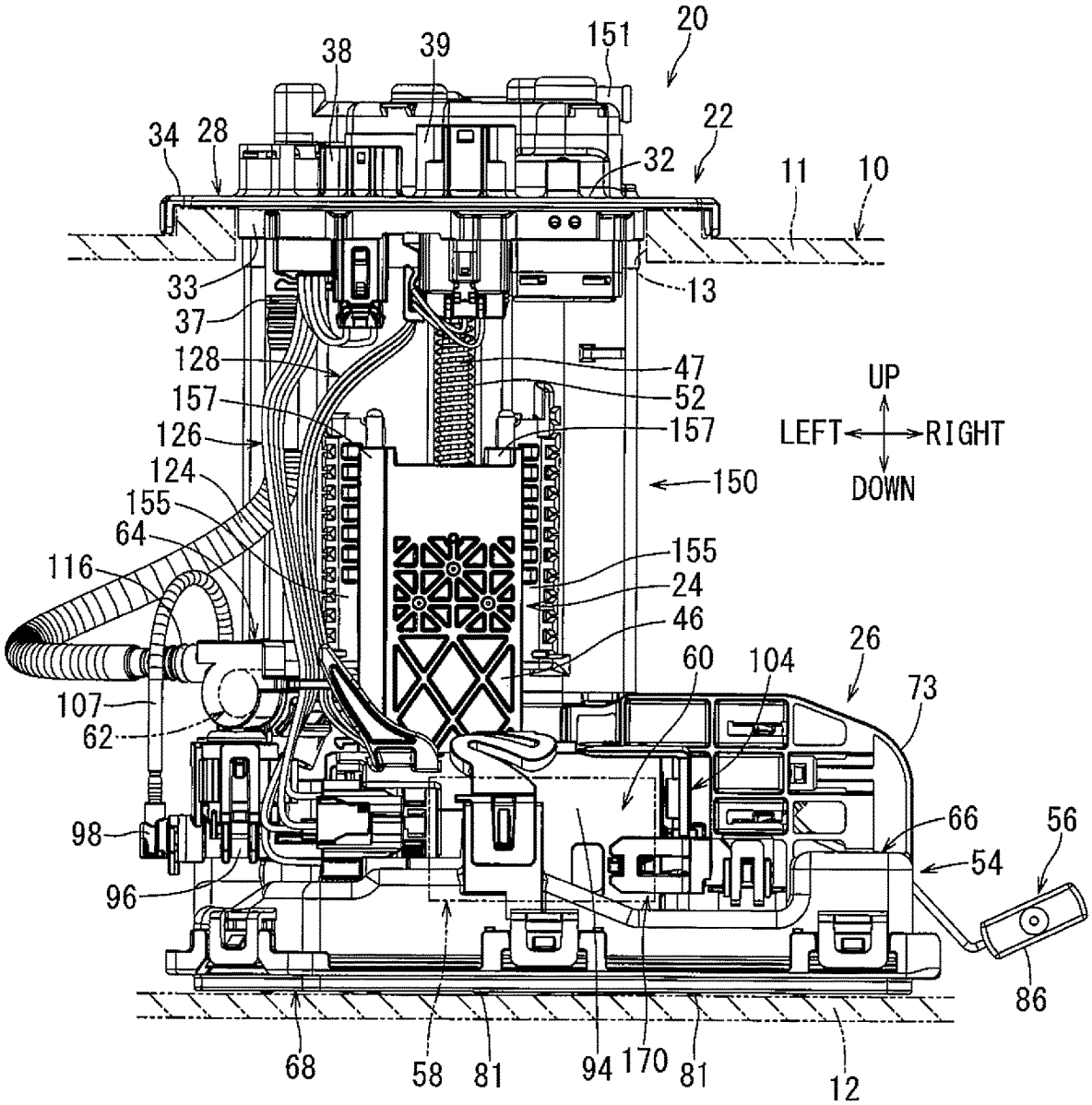
FIG. 2 is a front view of the fuel supply device of FIG. 1.
Figure 3:
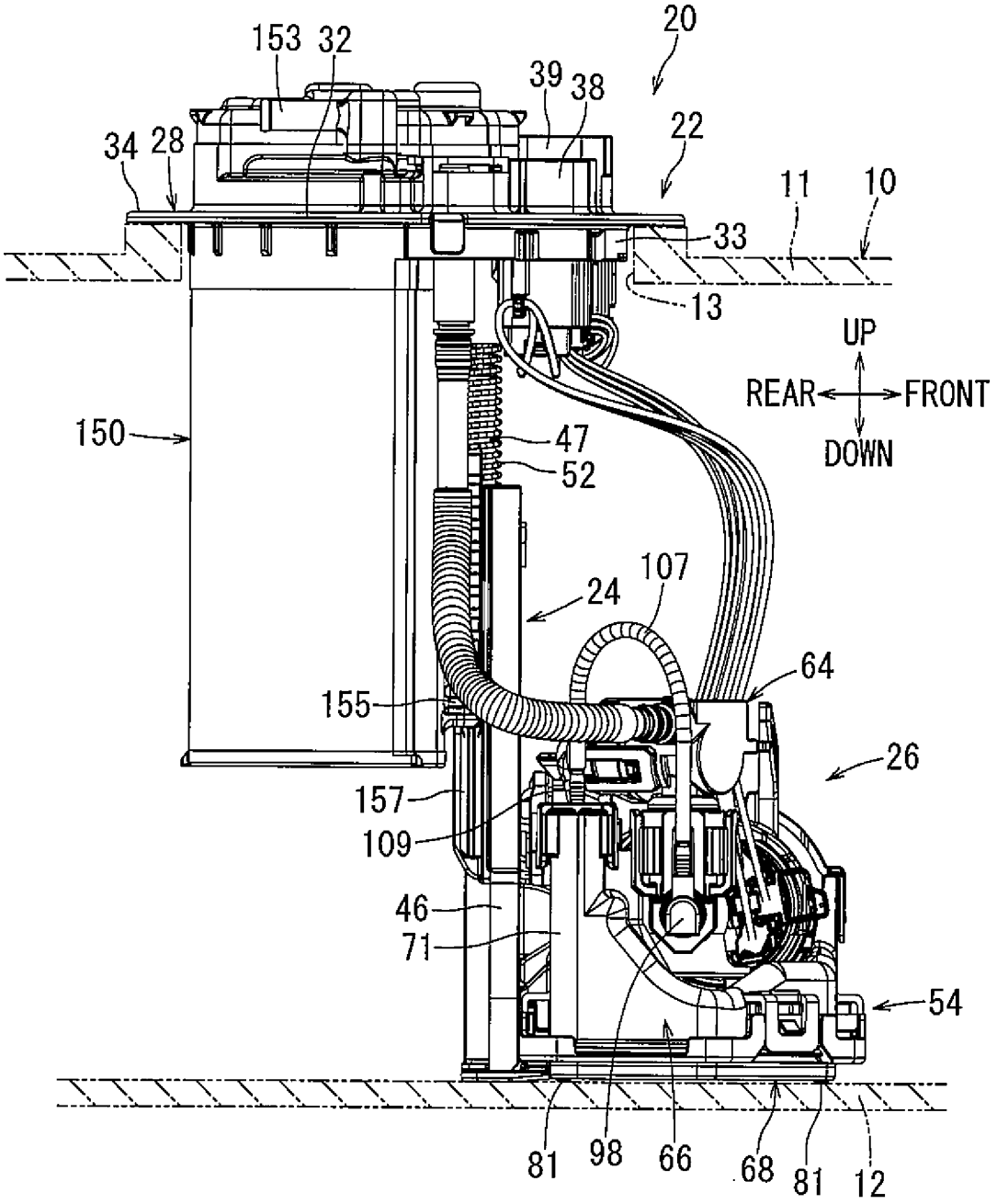
FIG. 3 is a left side view of the fuel supply device of FIG. 1.
Figure 4:
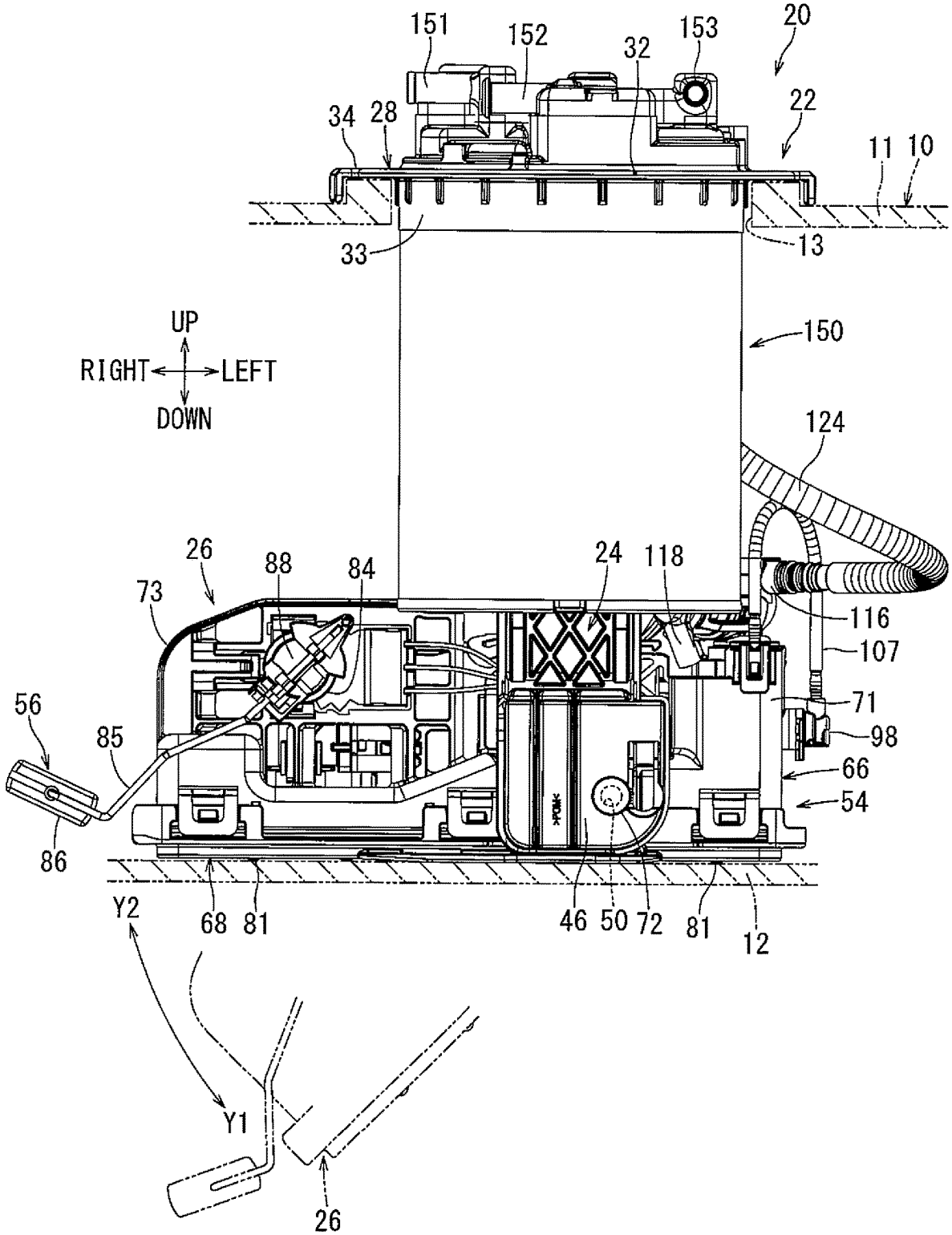
FIG. 4 is a rear view of the fuel supply device of FIG. 1.

Hereinafter, embodiments of apparatus and methods disclosed in the present description will be described with reference to the drawings. In particular, an embodiment of a fuel supply device is installed in a fuel tank mounted on a vehicle (e.g., an automobile or the like) equipped with an engine (e.g., an internal combustion engine) and serves to supply fuel in the fuel tank to the engine. FIG. 1 is a perspective view of the fuel supply device. FIG. 2 is a front view of the same. FIG. 3 is a left side view of the same. FIG. 4 is a rear side view of the same. In FIG. 1 to FIG. 4, frontward, rearward, leftward, rightward, upward, and downward directions are shown and correspond to directions of a vehicle. More specifically, a frontward/rearward direction corresponds to a vehicle length direction. A leftward/rightward direction corresponds to a vehicle width direction.

An upward/downward direction corresponds to a vehicle height direction. The frontward/rearward direction and the leftward/rightward direction of the fuel supply device may be oriented to any direction.

As shown in FIG. 2, a fuel tank 10 may be formed as a hollow container having an upper wall 11 and a bottom wall 12. An opening 13 may be formed as a circular hole in the upper wall 11. The fuel tank 10 may be mounted on a vehicle such that the upper wall 11 and the bottom wall 12 extend horizontally. The fuel tank 10 may be made of resin and may deform (expand or contract mainly in the upward/downward direction) in response to change in tank internal pressure. For example, gasoline as liquid fuel may be stored in the fuel tank 10.

As shown in FIG. 1, a fuel supply device 20 includes a flange unit 22, a joint member 24, and a pump unit 26. The joint member 24 is connected to the flange unit 22 so as to be movable in the upward/downward direction relative thereto, and the pump unit 26 is connected to the joint member 24 so as to be moveable in the upward/downward direction relative thereto.

The flange unit 22 includes a flange main body 28. The flange main body 28 includes a cover plate 32 having a circular plate shape. The flange main body 28 may be made of resin. As shown in FIG. 2, a fitting tubular portion 33 having a short cylindrical shape extends concentrically from a lower surface of the cover plate 32. An annular disc-like flange portion 34 extends radially outward from the fitting tubular portion 33 and is disposed about an outer periphery of the cover plate 32.

As shown in FIG. 1, a fuel outlet port 37, a first electric connector portion 38, and a second electric connector portion 39 are provided on the cover plate 32. The fuel outlet port 37 is a straight tube extending through the cover plate 32 in the upward/downward direction. The fuel outlet port 37 is disposed on a front left part of the cover plate 32. Both electric connector portions 38, 39 are arranged side by side at a front part of the cover plate 32. A predetermined number of metal terminals may be disposed in both electric connector portions 38, 39.

A canister 150 having a hollow container shape is formed at the flange main body 28. An outer contour of the canister 150 has a substantially semi-cylindrical shape that is concentric with the flange main body 28 at a rear half of the flange main body 28. The fitting tubular portion 33 is formed at an upper end of the semi-cylindrical wall of the canister 150. An adsorbent (e.g., activated carbon) that can adsorb and desorb fuel vapor generated within the fuel tank 10 is accommodated in the canister 150. Further, an evaporation port 151, an atmosphere port 152, and a purge port 153, which are in fluid communication with the inside of the canister 150, are formed on the upper surface of the flange main body 28. In addition, a pair of left and right fixed side rails 155 that extend linearly in the upward/downward direction are formed symmetrically on the front side of the canister 150 (see FIG. 2).

As shown in FIG. 2, the joint member 24 includes a joint main body 46, a spring guide 47, and a pair of left and right movable side rails 157. The joint main body 46 may be made of resin. In this embodiment, the joint main body 46 is a vertically elongated plate shape that is flat in the frontward/rearward direction and elongated in the upward/downward direction. An engagement hole 50 is formed in a lower portion of the joint main body 46 and extends therethrough in the frontward/rearward direction (see FIG. 4). The spring guide 47 is formed like a strut on and above the center of the joint main body 46. Further, both movable side rails 157 extend linearly on the left and right sides of an upper part of the joint member 24 in the upward/downward direction. Both movable side rails 157 are symmetrically formed at the joint main body 46 in the leftward/rightward direction.

A spring 52 comprising a metal cylindrical coil spring is fitted onto the spring guide 47 of the joint member 24. In this state, both movable side rails 157 of the joint member 24 are engaged with the fixed side rails 155 of the flange unit 22 so as to be movable relative thereto within a predetermined range in the upward/downward direction (see FIG. 3). In other words, the joint member 24 is connected to the flange unit 22 so as to be movable in the upward/downward direction. Further, the flange main body 28 and the joint main body 46 are biased away from each other by the spring 52.

Figure 5:
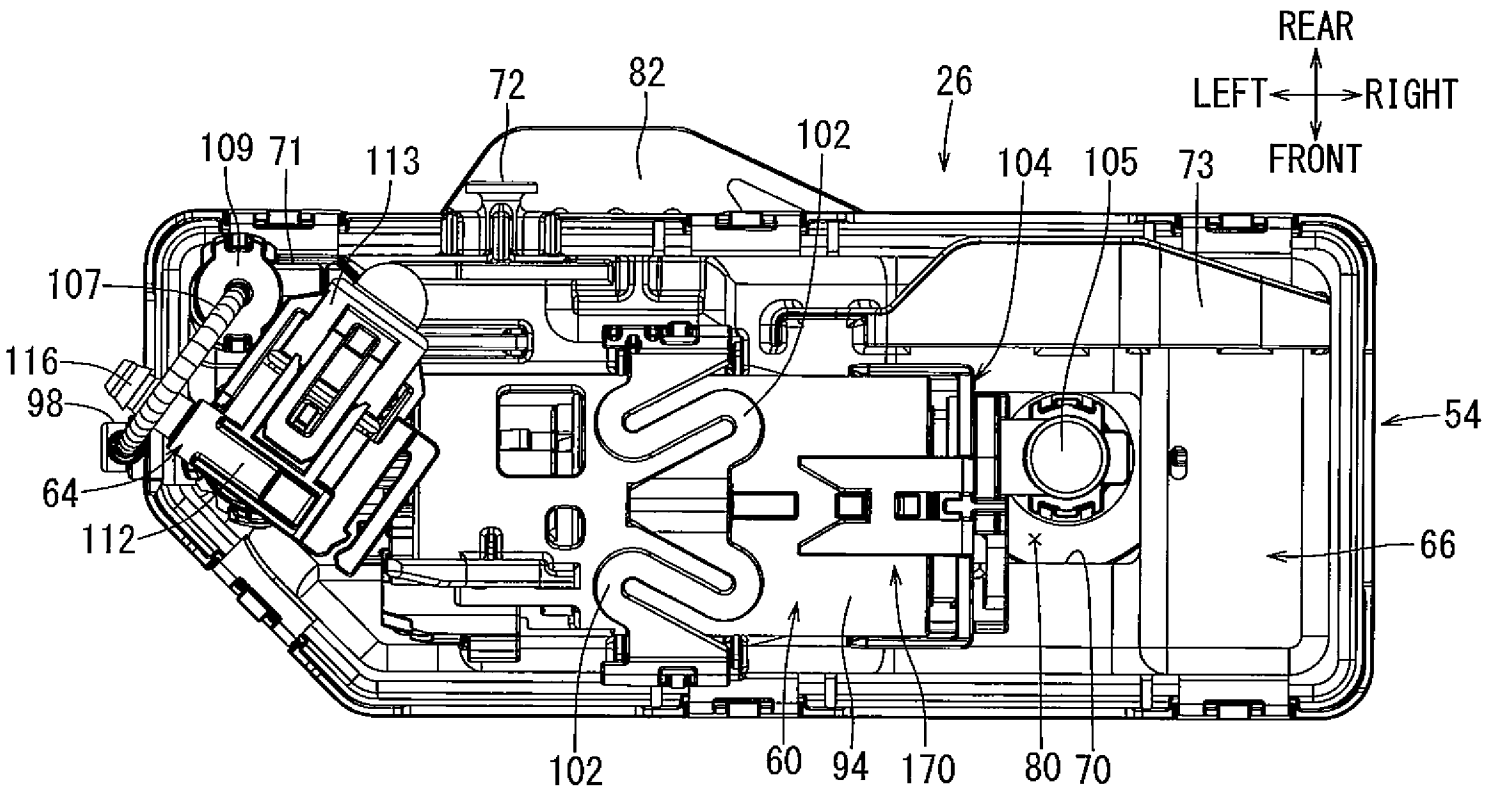
FIG. 5 is a top view of the pump unit of FIG. 1.
Figure 6:
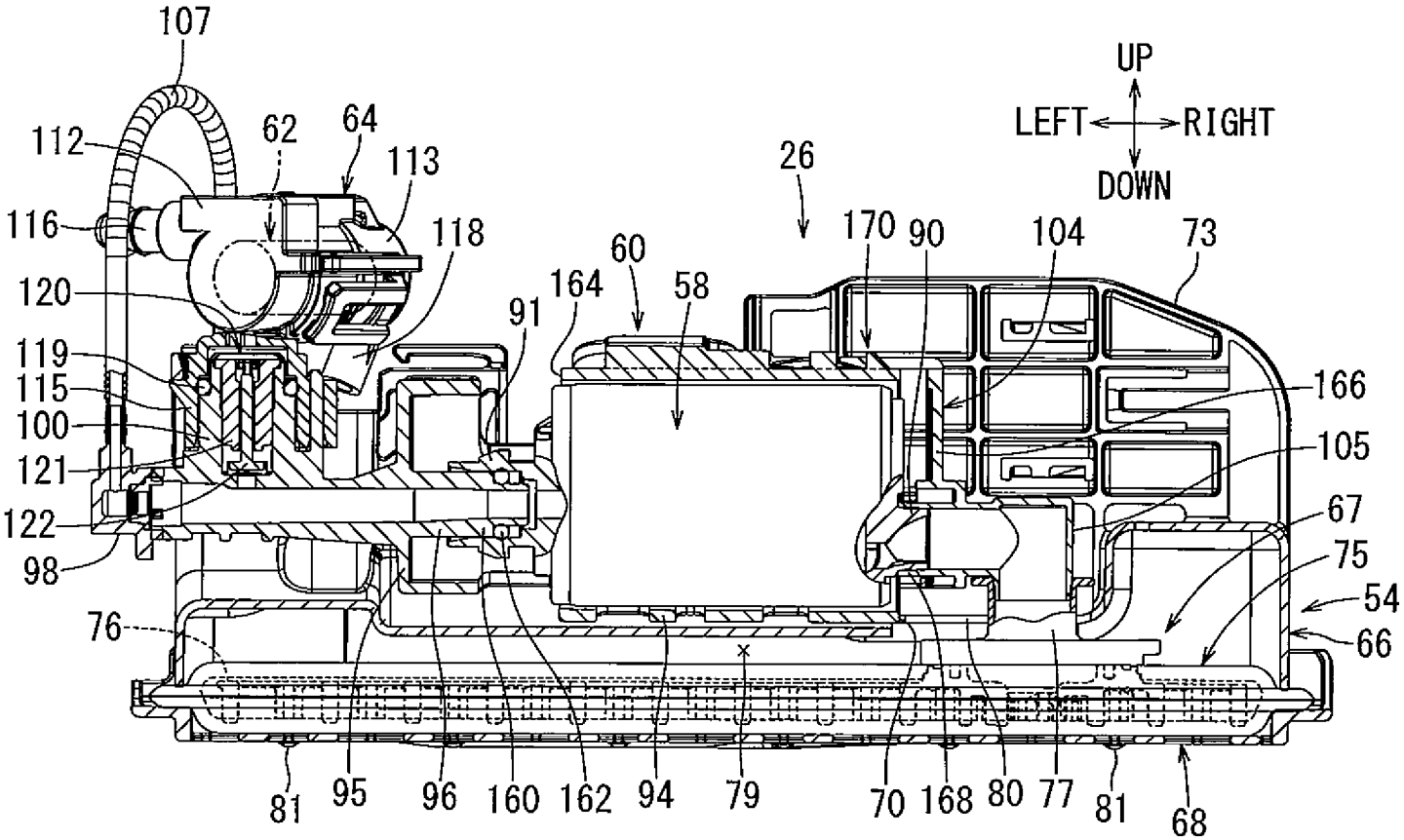
FIG. 6 is a partial cutaway, front view of the pump unit of FIG. 5.

As shown in FIG. 2, the pump unit 26 includes a sub-tank 54, a sender gauge 56, a fuel pump 58, a pump case 60, a pressure regulator 62, and a regulator case 64. FIG. 5 shows a top view of the pump unit 26. FIG. 6 is a partially cutaway front view of the same. For purposes of clarity, the sender gauge 56 is not shown in FIG. 5 and FIG. 6.

As shown in FIG. 6, the sub-tank 54 include a sub-tank main body 66, a fuel filter 67, and a cover member 68.

The sub-tank main body 66 may be made of resin and formed in an inverted shallow box shape with the bottom side opened. In particular, the sub-tank main body 66 may be formed to have a rectangular shape elongated in the leftward/rightward direction in a top view (see FIG. 5). A rectangular opening hole 70 is formed to the right on the top side of the sub-tank main body 66. A fuel receiving tubular portion 71 is formed to the left rear of the top side of the sub-tank main body 66 (see FIGS. 3 and 4). The fuel receiving tubular portion 71 has a rectangular tubular shape extending upwardly. The top side of the fuel receiving tubular portion 71 is opened.

A rearward projecting engagement shaft 72 is provided to the left on a lower portion of the rear side of the sub-tank main body 66 (see FIGS. 4 and 5). Further, a plate-like upright wall 73 facing the frontward/rearward direction is provided on the right rear portion of the top side of the sub-tank main body 66.

The fuel filter 67 includes a filter member 75, an inner frame member 76, and a connecting pipe 77. The filter member 75 has a hollow bag shape with a filter material made of resin non-woven fabric. A contour of the filter member 75 has an elongated rectangular shape, which is flat in the upward/downward direction, such that its longitudinal direction corresponds to the leftward/rightward direction.

The inner frame member 76 may be made of resin and have a skeleton structure that retains the filter member 75 in an expanded or inflated state in the upward/downward direction. Further, the connecting pipe 77 may be made of resin and formed into a vertical round tube shape. The connecting pipe 77 is joined on the right portion of the inner frame member 76 by heat fusion. An upper side of the filter member 75 is interleaved between the inner frame member 76 and the connecting pipe 77. The inside and the outside of the filter member 75 are in fluid communication via the connecting pipe 77.

The filter member 75 is arranged so as to close the bottom opening of the sub-tank main body 66. A fuel storage space 79 for storing fuel is provided between the sub-tank main body 66 and the filter member 75. The connecting pipe 77 is disposed within the opening hole 70 of the sub-tank main body 66. An annular space between the opening hole 70 and the connecting pipe 77 defines a fuel flow inlet 80. The fuel in the fuel tank 10 (see FIG. 2) may flow into the fuel storage space 79 through the flow inlet 80 under its own weight.

The cover member 68 has an elongated rectangular plate shape including a plurality of openings. The cover member 68 may be made of resin. The cover member 68 is coupled to the sub-tank main body 66 by snap-fitting. A peripheral edge of the filter member 75 is interleaved between peripheral edges of the sub-tank main body 66 and the cover member 68. The cover member 68 covers a lower side of the filter member 75. A plurality of semi-spherical projections 81 are formed on a lower side of the cover member 68 in a distributed manner.

As shown in FIG. 4, the sender gauge 56 includes a gauge main body 84, an arm 85, and a float 86. The gauge main body 84 is attached to a rear side of the upright wall 73 of the sub-tank main body 66. A base end portion of the arm 85 is attached to a rotating portion 88, which rotatably couples the arm 85 to the gauge main body 84, thereby allowing the arm 85 to rotate about a horizontal axis. The float 86 is attached to a free end portion of the arm 85. The sender gauge 56 is a liquid level meter configured to detect a residual amount of fuel in the fuel tank 10, i.e., a position of the liquid level.

As shown in FIG. 6, the fuel pump 58 may be an electric fuel pump formed in a substantially cylindrical columnar shape. The fuel pump 58 includes a motor portion and a pump portion that function to draw, pressurize fuel, and discharge the fuel. The fuel pump 58 includes a fuel suction port 90 on a pump portion side end (right end) and a fuel discharge port 91 on a motor portion side end (left end). Further, an electric connector is provided on the motor portion side end of the fuel pump 58. For example, a brushless DC motor may be used for the motor portion.

The pump case 60 includes a case main body 94 having a hollow cylindrical shape extending in the leftward/rightward direction. The pump case 60 may be made of resin. An end plate 95 is formed at an opening on one side (a left side opening) of the case main body 94 for closing the opening. A discharge pipe portion 96 comprising a straight tube extends through the end plate 95 and is provided in the center of the end plate 95. A resin pipe joint 98 having an elbow shape is joined at a tip end of the discharge pipe portion 96 by welding. Further, a connecting tubular portion 100 having an upward projecting cylindrical shape is positioned toward the tip end of the discharge pipe portion 96. The inside of the connecting tubular portion 100 is in fluid communication with the inside of the discharge pipe portion 96.

The fuel pump 58 is accommodated in the case main body 94 with the fuel discharge port 91 oriented to the left. The fuel discharge port 91 is connected to a discharge port connector 160 at an end (right end) of the discharge pipe portion 96. In this embodiment, the discharge port connector 160 functions as a male plug while the fuel discharge port 91 serves as a female socket that receives the mating male plug (i.e., the discharge port connector 160). A tapered surface may be formed on the inner peripheral surface of a tip end of the fuel discharge port 91, with the diameter gradually enlarged from the base side toward its tip.

An O-ring 162 is interposed between the fuel discharge port 91 and the discharge port connector 160 for elastically sealing a gap therebetween. The O-ring 162 may also be referred to herein as a "sealing member." A window 164 is formed in the case main body 94 for allowing the connected state between the discharge port connector 160 and the fuel discharge port 91 to be visible (see FIG. 9).

As shown in FIG. 5, a pair of front and rear elastic support pieces 102 extending in opposite directions are provided on an upper end of the center of the case main body 94 and are symmetrical in the frontward/rearward direction. Each elastic support piece 102 has a strip shape and is formed in a substantially S-shape in a plan view. The tip ends of the elastic support pieces 102 are integrally connected to the front and rear sides of the sub-tank main body 66 by snap-fitting. The pump case 60 is elastically supported on the sub-tank main body 66 in a horizontal orientation, i.e., a laterally placed state, by the elastic support pieces 102.

As shown in FIG. 6, a resin cap 104 is integrally connected to the case main body 94 by snap-fitting so as to close a right end opening of the case main body 94. The cap 104 includes a disc-shaped cap main body 166. A suction pipe portion 105 having an elbow pipe shape is formed on the cap 104. The fuel suction port 90 of the fuel pump 58 is connected to a suction port connector 168 formed at one end (left end) of the suction pipe portion 105. The fuel suction port 90 serves as a male plug while the suction port connector 168 serves as a female socket. The other end (lower end) of the suction pipe portion 105 is connected to the connecting pipe 77 of the fuel filter 67. In this embodiment, the suction pipe portion 105 is integrally connected to the connecting pipe 77 by snap-fitting.

As shown in FIG. 5, one end of a fuel discharge tube 107 made of a resin flexible tube is connected to the pipe joint 98 by press fitting. In addition, a nozzle member 109 is connected to the other end of the fuel discharge tube 107 by press fitting. The nozzle member 109 may be integrally connected on a left rear portion of the fuel receiving tubular portion 71 by snap-fitting (see FIG. 3). The fuel discharge tube 107 is bent in an inverted U-shape.

As shown in FIG. 6, a contour of the pressure regulator 62 has a substantially cylindrical columnar shape. The pressure regulator 62 serves to regulate the pressure of the pressurized fuel discharged from the fuel pump 58, i.e., the pressure of fuel to be supplied to an engine, at a predetermined pressure.

The pressure regulator case 64 may be made of resin and is formed to have a hollow cylindrical container shape. The regulator case 64 may include a first case half 112 and a second case half 113 divided in the axial direction. The case halves 112, 113 are integrally connected to each other by snap-fitting. The pressure regulator 62 is disposed in the regulator case 64. The regulator case 64 is disposed in a laterally placed state where the axial direction thereof is horizontal.

A cylindrical connected tubular portion 115 projecting downwardly and a fuel discharge portion 116 projecting outwardly from the upper end in the tangential direction are formed on the first case half 112. The connected tubular portion 115 and the fuel discharge portion 116 are in fluid communication with a fuel introduction port of the pressure regulator 62 within the first case half 112.

A discharge pipe portion 118 projecting downward from an end opposite to the first case half 112 is formed on the second case half 113. The discharge pipe portion 118 is in fluid communication with a surplus fuel discharge port of the pressure regulator 62 disposed within the second case half 113. The fuel discharge portion 116 discharges the fuel, of which pressure is regulated in the pressure regulator 62. Surplus fuel from the pressure regulator 62 is discharged through the discharge pipe portion 118.

The connected tubular portion 115 of the regulator case 64 is fitted so as to be connected to the connecting tubular portion 100 of the pump case 60. An O-ring 119 is interposed between the connecting tubular portion 100 and the connected tubular portion 115 for elastically sealing a gap therebetween. Further, the fuel discharge portion 116 is oriented in the rear left direction from the upper end of the first case half 112 (see FIG. 5). Furthermore, the discharge pipe portion 118 is oriented to the inside of the fuel receiving tubular portion 71 of the sub-tank main body 66 (see FIG. 4).

A check valve 120 is incorporated into the connecting tubular portion 100 of the pump case 60. The check valve 120 may be a residual-pressure retention check valve, which serves to prevent backflow of pressurized fuel in the connecting tubular portion 100. The check valve 120 includes a valve guide 121 and a valve body 122. The valve guide 121 is fixedly disposed within the connecting tubular portion 100. The valve body 122 is disposed in the valve guide 121 so as to be concentric and axially movable (upward/downward direction), i.e., so as to open and close. The valve body 122 may close under its own weight and open by fuel pressure.

As shown in FIG. 4, an engagement shaft 72 of the sub-tank main body 66 is rotatably engaged in an engagement hole 50 of the joint main body 46. As a result, the pump unit 26 is rotatably connected to the joint member 24 in the upward/downward direction (see directions indicated by arrows Y1, Y2 in FIG. 4).

As shown in FIG. 2, the fuel outlet port 37 in the flange main body 28 is connected to the fuel discharge portion 116 at the regulator case 64 via a discharge fuel pipe 124. The discharge fuel pipe 124 may be made of a flexible resin hose or the like. Also, the discharge fuel pipe 124 may be formed in a bellows shape.

The first electric connector portion 38 on the flange main body 28 is electrically connected to an electric connector for the fuel pump 58 via a first wire harness 126. The second electric connector portion 39 on the flange main body 28 is electrically connected to the gauge main body 84 of the sender gauge 56 (see FIG. 4) via a second wire harness 128. The first wire harness 126 and the second wire harness 128 are attached to a wiring hook portion, which is integrally formed with an adjacent resin member.

The fuel supply device 20 is extended when being installed in the fuel tank 10. In this state, the joint member 24 is suspended by the flange unit 22 while the pump unit 26 is suspended by the joint member 24. Specifically, the joint member 24 is lowered to its lowermost position (farthest position) with respect to the flange unit 22. Further, the pump unit 26 is rotated in an inclined state downward to right (see the arrow Y1 in FIG. 4) of the joint member 24 (see two-dot chain line 26 in FIG. 4).

Subsequently, the pump unit 26 is inserted in the opening 13 of the fuel tank 10 from its top while the fuel supply device 20 is still in its extended state. The pump unit 26 is mounted on the bottom wall 12 of the fuel tank 10 by being rotated relative to the joint member 24 in a direction opposite to that of being suspended (see the arrow Y2 in FIG. 4) so as to be placed horizontally (see FIGS. 2 to 4). Further, a rotation limiting mechanism for limiting rotation beyond the horizontal state of the pump unit 26 is provided between the joint member 24 and the pump unit 26.

The canister 150 is then fitted in the opening 13 of the fuel tank 10 as the flange unit 22 is pressed downward against the biasing force of the coil spring 52. In this state, the flange portion 34 of the flange main body 28 is fixed to the upper wall 11 of the fuel tank 10 via fixing means (not shown), such as metal fixtures or bolts (see FIGS. 2 to 4). The installation of the fuel supply device 20 to the fuel tank 10 is thus completed as described above.

The pump unit 26 is biased against the bottom wall 12 of the fuel tank 10 by the biasing force of the spring 52 in the installed state of the fuel supply device 20 (see FIGS. 2 to 4). Further, the projections 81 on the cover member 68 abut the bottom wall 12 of the fuel tank 10, thereby ensuring flow of fuel between the cover member 68 and the bottom wall 12.

Incidentally, the fuel tank 10 may deform, i.e., expand or contract in response to a change in tank internal pressure caused by a change in temperature or a change in the amount of fuel. Consequently, the distance between the upper wall 11 and the bottom wall 12 of the fuel tank 10 may vary (increase or decrease). In this case, the flange unit 22 and the joint member 24 move relatively to each other in the upward/downward direction so as to follow the change in the height of the fuel tank 10.

A fuel feed pipe leading to an engine is connected to the fuel outlet port 37 of the flange unit 22. External connectors are each connected to the first electric connector portion 38 or the second electric connector portion 39. A fuel vapor passage leading to a breather piping of the fuel tank is connected to the evaporation port 151. The atmosphere port 152 opens to the atmosphere. The purge passage leading to an intake passage of an engine is connected to the purge port 153.

The fuel pump 58 is driven by an external drive power source. The fuel from the interior of the fuel tank 10 that is to pass through the cover member 68 and/or fuel within the fuel storage space 79 of the pump unit 26 is drawn in by the fuel pump 58 via the fuel filter 67 and pressurized. The pressurized fuel discharged from the fuel pump 58 flows into the regulator case 64 via the discharge pipe portion 96 of the pump case 60, and the pressure of the fuel is regulated by the pressure regulator 62. The pressurized fuel having a regulated pressure is supplied to the engine through the fuel outlet port 37 of the flange unit 22 via the discharge fuel pipe 124.

The surplus fuel resulting from regulation of the fuel pressure using the pressure regulator 62 is discharged through the discharge pipe portion 118 at the regulator case 64 into the fuel receiving tubular portion 71 of the sub-tank main body 66. Further, a portion of the pressurized fuel discharged from the fuel pump 58 into the discharge pipe portion 96 of the pump case 60 is discharged into the fuel receiving tubular portion 71 of the sub-tank main body 66 via the fuel discharge tube 107.

The fuel vapor generated in the fuel tank 10 is introduced into the canister 150 from the fuel vapor passage via the evaporation port 151. The fuel vapor in the canister 150 is purged into the intake passage via the purge passage due to the negative intake pressure. The atmospheric air is introduced into the canister 150 when the fuel vapor in the canister 150 is purged.

Figure 7:
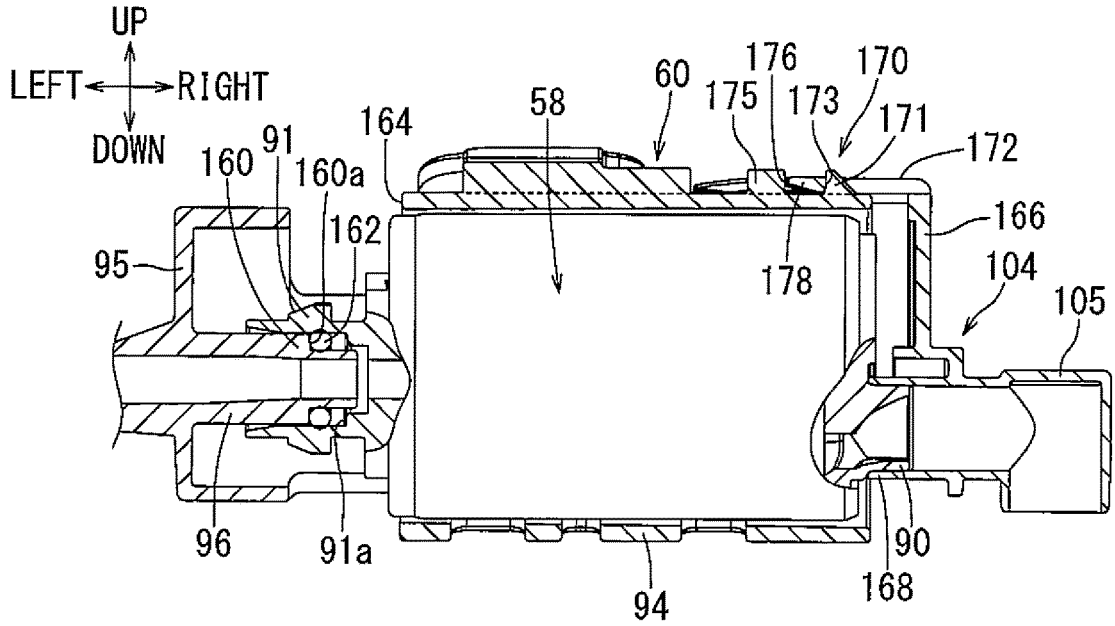
FIG. 7 is a cross-sectional view of the fuel pump, the pump case, and the cap of FIG. 1 in a fully assembled state.
Figure 8:
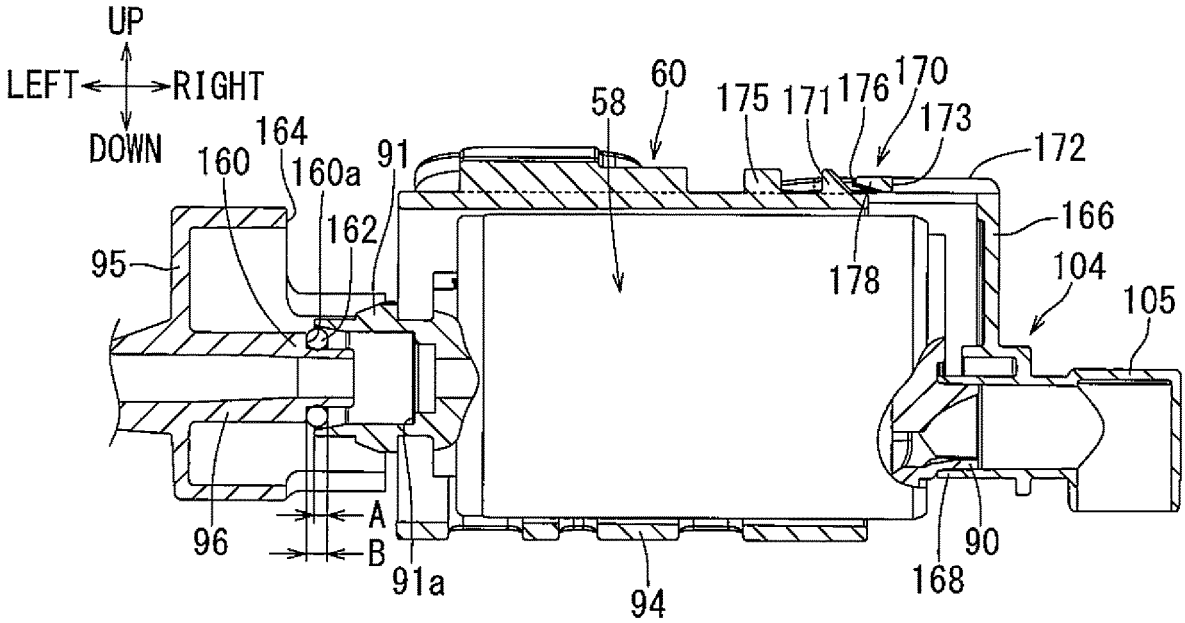
FIG. 8 is a cross-sectional view of the fuel pump, the pump, and the cap of FIG. 1 during the process of being assembled.
Figure 9:
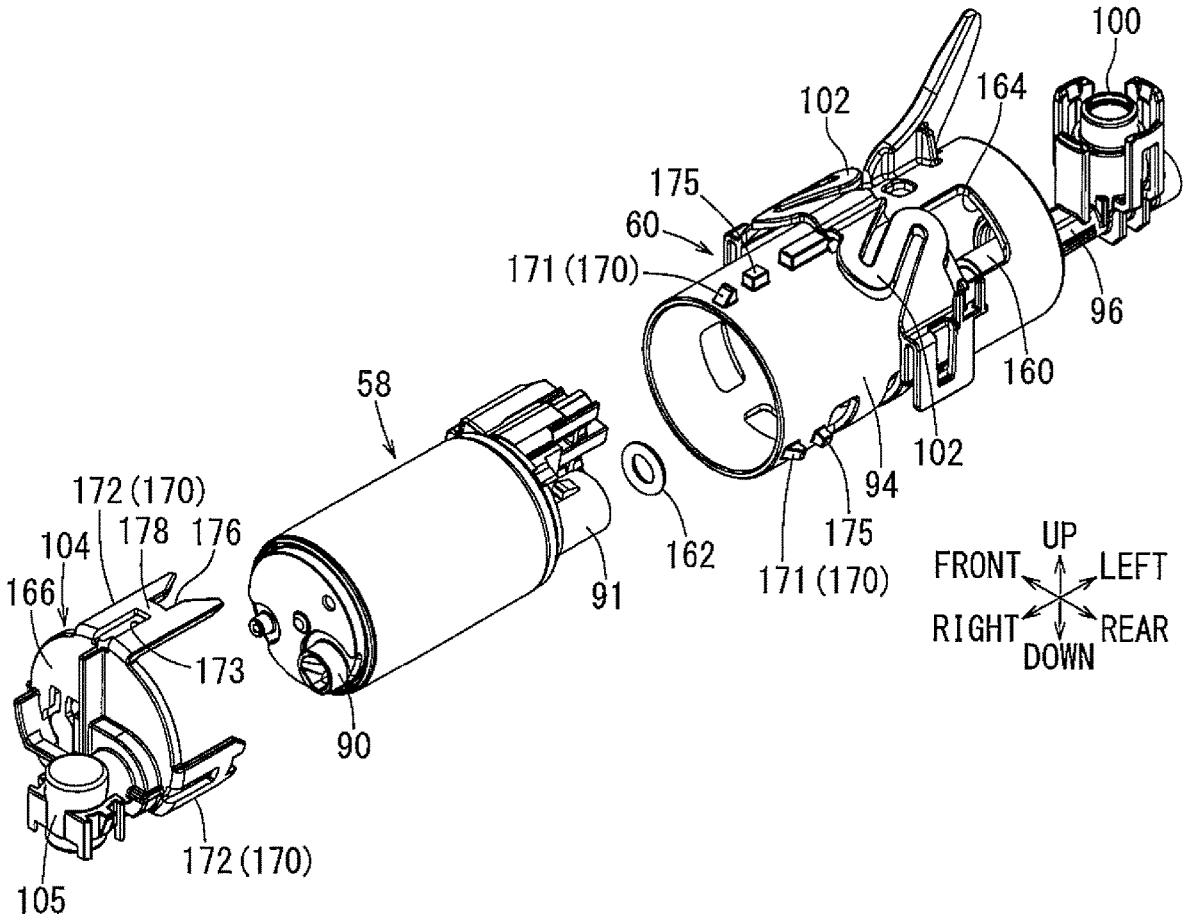
FIG. 9 is a perspective, exploded view of the fuel pump, the pump, and the cap of FIG. 1.

FIG. 7 is a cross-sectional view illustrating the fuel pump 58, the pump case 60, and the cap 104 in a fully assembled state. FIG. 8 is a cross-sectional view of the same during assembly. FIG. 9 is similarly an exploded perspective view. As shown in FIG. 7, a connector or connection assembly 170 is provided between the pump case 60 and the cap 104 so as to connect them to each other in the axial direction with the fuel pump 58 is inserted in the case main body 94 (see FIG. 7).

As shown in FIG. 9, in this embodiment, the connection assembly 170 comprises three (FIG. 9 shows two of three) circumferentially-spaced engagement projections 171 projecting from the outer peripheral surface of the case main body 94 and three (FIG. 9 shows two of three) circumferentially-spaced engagement pieces 172 extending from the cap 104. The connection assembly 170 may also be described as a "snap-fit" for reasons described in more detail below. Further, the engagement projection 171 may also be referred to herein as a "engaging portion," and the engagement piece 172 may also be referred to herein as a "engaged portion."

The three engagement projections 171 are uniformly circumferentially-spaced about the case main body 94. Further, the three engagement pieces 172 extend from the cap main body 166 in a cantilever manner. The three engagement pieces 172 are arranged in positions corresponding to the three engagement projections 171. The engagement pieces 172 have a strip, plate shape extending along the outer side of the case main body 94 in the axial direction (leftward/rightward direction). An engagement groove 173 is formed in each engagement piece 172 and is configured to mate and engage a corresponding engagement projection 171. The engagement pieces 172 have elasticity to allow flexible deformation in the radially outward direction of the cap main body 166.

Positioning protrusions 175 are disposed on the outer peripheral surface of the case main body 94 at a predetermined distance to the left of the engagement projections 171. Further, positioning grooves 176 configured to mate and engage the positioning projections 175 are formed at tip ends of the engagement pieces 172. Each positioning groove 176 has a substantially a U-shape. Between each engagement groove 173 and the corresponding positioning groove 176, an inter-groove portion 178 is formed and is configured to be positioned between the engagement projection 171 and the positioning projection 175 without a gap (see FIG. 7).

A shown in FIG. 8, the O-ring 162 is mounted to the discharge port connector 160 of the pump case 60. The O-ring 162 is in contact with a stepped surface 160*a* disposed on the outer peripheral surface of the discharge port connector 160. Further, the cap 104 is pushed toward the pump case 60 while the fuel pump 58 is inserted into the case main body 94 in a state where the fuel suction port 90 of the fuel pump 58 connected to the suction port connector 168 of the cap 104.

Then, the bottoms of the engagement grooves 173 of the engagement pieces 172 of the cap 104, namely, the inter-groove portions 178, come in contact with or come close to the engagement projections 171 of the pump case 60. In the present embodiment, the time when the pump case 60 and the cap 104 are coaxially aligned with the base ends (right ends) of the engagement projections 171 positioned adjacent the left ends of the inter-groove portions 178 defines the beginning of the engagement of the engagement projections 171 with the engagement pieces 172.

The engagement projections 171, the engagement pieces 172, the fuel discharge port 91, and the discharge port connector 160 are sized and positioned such that at the beginning of the engagement of the engagement projections 171 and the engagement pieces 172, the tip end of the fuel discharge port 91 reaches the O-ring 162. At this beginning of the engagement, the axial overlap or fitting distance A between the fuel discharge port 91 to the O-ring 162 is equal to or greater than ½ of the axial thickness B of the O-ring 162 in a free, uncompressed state. In the present embodiment, the fitting distance A is set at a value slightly greater than ½ of the thickness B.

The engagement grooves 173 engage with the engagement projections 171 utilizing elastic deformation (flexible deformation) of the engagement pieces 172 (see FIG. 7) as the cap 104 is pushed toward the pump case 60 from the beginning of the engagement of the engagement projections 171 of the pump case 60 with the engagement pieces 172 of the cap 104 (see FIG. 8). Simultaneously, the engagement grooves 176 of the engagement pieces 172 engage with the respective positioning projections 175 of the pump case 60. Further, the inter-groove portions 178 of the engagement pieces 172 are engaged between the engagement projections 171 and the respective positioning projections 175. In this way, the pump case 60 is connected to the cap 104 by a snap-fit.

The discharge port connector 160 of the pump case 60 is inserted into the fuel discharge port 91 of the fuel pump 58 together with the O-ring 162 as the cap 104 is pushed toward the pump case 60. Upon completion of the connection of the cap 104 to the pump case 60, the connection of the discharge port connector 160 of the pump case 60 with the fuel discharge port 91 of the fuel pump 58 is completed such that the O-ring 162 seals a gap between the discharge port connector 160 and the fuel discharge port 91. In particular, the O-ring 162 is held and compressed between the stepped surface 160*a* of the discharge port connector 160 and a stepped surface 91*a* formed on the inner peripheral surface of the fuel discharge port 91.

According to embodiments of the fuel supply device 20 disclosed herein, the engagement between the engagement projections 171 and the engagement pieces 172 of the connection assembly 170 proceeds while the O-ring 162 attached to the discharge port connector 160 of the pump case 60 also engages the fuel discharge port 91. Therefore, it is possible to prevent inadvertent damage, such as twisting or biting, to the O-ring 162 interposed between the fuel discharge port 91 of the fuel pump 58 and the discharge port connector 160 of the pump case 60 during assembly.

In addition, the diameter of the fuel discharge port 91 of the fuel pump 58 can be enlarged by forming the discharge port connector 160 of the pump case 60 as a male plug and the fuel discharge port 91 of the fuel pump 58 as a female socket, compared with the case where the discharge port connector 160 of the pump case 60 serves as a female socket and the fuel discharge port 91 of the fuel pump 58 serves as a male plug.

Further, the pump case 60 may be formed with the window 164 for allowing the connected state of the fuel discharge port 91 of the fuel pump 58 to be visible. Therefore, the connection condition of the fuel discharge port 91 of the fuel pump 58 can be visually checked through the window 164 of the pump case 60.

Further, the fitting distance A of the fuel discharge port 91 of the fuel pump 58 with respect to the O-ring 162 at the beginning of the engagement between the engagement projections 171 and the engagement pieces 172 of the connection assembly 170 is equal to or greater than ½ of the thickness of the O-ring 162 in the axial direction. As a result, the O-ring 162 is more securely attached to the fuel discharge port 91 of the fuel pump 58 than in the case where the fitting amount A of the fuel discharge port 91 of the fuel pump 58 with respect to the O-ring 162 at the beginning of the engagement between the engagement projections 171 and the engagement pieces 172 of the connection assembly 170 is less than ½ of the thickness of the O-ring 162 in the axial direction.

The embodiments disclosed in the present description shall not be limited to the embodiment described above, but various modification may be made. For example, embodiments disclosed in the present description shall not be limited to the fuel supply device 20 for a vehicle, such as an automobile, and may also be applied to other fuel supply devices. Further, the engagement projections 171 of the connection assembly 170 may be provided on the cap 104, while the engagement pieces 172 are provided on the pump case 60. Further, the discharge port connector 160 of the pump case 60 may serve as a female socket, and the fuel discharge port 91 of the fuel pump 58 may serve as a male plug. Moreover, a ring-shaped sealing member having elasticity may be used instead of the O-ring 162.

As described-above, embodiments have been disclosed herein in various aspects. A first aspect relates to a fuel supply device, which includes a fuel pump, a pump case including a case main body allowing the fuel pump to be axially inserted therein and a discharge port connector configured to be connected to a fuel discharge port of the fuel pump, a cap including a suction port connector configured to be connected to a fuel suction port of the fuel pump, a sealing member interposed between the fuel discharge port and the discharge port connector, and a snap-fit including engaging portions and engaged portions, which are configured to engage with each other so as to connect the pump case to the cap. During assembly of the fuel suction port of the fuel pump and the suction port connector of the cap, the fuel discharge port of the fuel pump reaches the sealing member attached to the discharge port connector of the pump case simultaneous with the beginning of engagement between the engaging portions and the engaged portions of the snap-fit.

According to the first aspect, the engagement between the engaging portions and the engaged portions of the snap-fit occurs while the sealing member mounted to the discharge port connector of the pump case engages the fuel discharge port of the fuel pump. Therefore, it is possible to prevent assembly failures, such as twisting or biting, of the sealing member interposed between the fuel discharge port of the fuel pump and the discharge port connector of the pump case.

A second aspect is the fuel supply device of the first aspect, in which the discharge port connector of the pump case serves as a male plug and the fuel discharge port of the fuel pump serves as a female socket.

According to the second aspect, the diameter of the fuel discharge port of the fuel pump can be enlarged as compared with a case where the discharge port connector of the pump case serves as a female socket and the fuel discharge port of the fuel pump serves as a male plug.

A third aspect is the fuel supply device of the first or second aspect, in which a window is formed at the pump case for allowing the fuel discharge port of the fuel pump to be visible.

According to the third aspect, the fuel discharge port of the fuel pump can be visually checked through the window of the pump case during assembly.

A fourth aspect is the fuel supply device of any one of the first to third aspects, in which a fitting distance of the fuel discharge port of the fuel pump with respect to the sealing member at the time of beginning engagement between the engaging portions and the engaged portions of the snap-fit is equal to or greater than ½ of an axial thickness of the sealing member.

According to the fourth aspect, the sealing member can be more securely attached to the fuel discharge port of the fuel pump than in the case where the fitting amount of the fuel discharge port of the fuel pump with respect to the sealing member at the beginning of the engagement between the engaging portions and the engaged portions is less than ½ of the thickness of the sealing member in the axial direction.

What is claimed is:

1. A fuel supply device comprising:

a fuel pump including a fuel discharge port and a fuel suction port;

a pump case including a case main body and a discharge port connector, wherein the case main body is configured to axially received the fuel pump therein, and wherein the discharge port connector is connected to be connected to the fuel discharge port of the fuel pump;

a cap including a suction port connector configured to be connected to the fuel suction port of the fuel pump;

a sealing member interposed between the fuel discharge port and the discharge port connector; and a snap-fit connecting the pump case to the cap, wherein the snap-fit includes a plurality of engaging portions and a plurality of engaged portions, wherein the plurality of engaged portions mate and engage the plurality of engaging portions, wherein the fuel discharge port of the fuel pump is configured to reach the sealing member coupled to the discharge port connector of the pump case upon engagement of the plurality of engaging portions and the plurality of engaged portions of the snap-fit when the fuel suction port of the fuel pump and the suction port connector of the cap are connected to each other.

2. The fuel supply device according to claim 1, wherein:

the discharge port connector of the pump case is a male plug; and the fuel discharge port of the fuel pump is a female socket configured to mate with and receive the male plug.

3. The fuel supply device according to claim 1, wherein the pump case includes a window configured to allow visibility of the fuel discharge port of the fuel pump.

4. The fuel supply device according to claim 1, wherein a fitting distance of the fuel discharge port of the fuel pump and the sealing member upon engagement of the plurality of engaging portions and the plurality of engaged portions of the snap-fit is equal to or greater than ½ of an axial thickness of the sealing member.

* * * * *